United States Patent [19]

Grane

[11] 4,145,156

[45] Mar. 20, 1979

[54] PLATE VIBRATOR

[75] Inventor: Gunnar Grane, Ljungby, Sweden

[73] Assignee: Dynapac Maskin AB, Solna, Sweden

[21] Appl. No.: 824,510

[22] Filed: Aug. 15, 1977

[30] Foreign Application Priority Data

Aug. 24, 1976 [SE] Sweden ..... 7609352

[51] Int. Cl.[2] ..... E01C 19/30

[52] U.S. Cl. ..... 404/113; 404/117

[58] Field of Search ..... 404/113, 117; 74/61

[56] References Cited

U.S. PATENT DOCUMENTS

| | | | |
|---|---|---|---|
| 3,292,512 | 12/1966 | Schaperclaus | 404/113 |
| 3,342,118 | 9/1967 | Beierlein | 404/113 |
| 3,385,119 | 5/1968 | Berger | 404/113 X |
| 3,618,485 | 11/1971 | Hermann | 404/117 |
| 3,814,533 | 6/1974 | Buck | 404/117 X |
| 3,878,733 | 4/1975 | Tertinek | 404/113 X |

*Primary Examiner*—Nile C. Byers, Jr.
*Attorney, Agent, or Firm*—Brumbaugh, Graves, Donohue & Raymond

[57] ABSTRACT

A plate vibrator for compacting soil, asphalt and similar materials comprises a bottom plate on which is rigidly mounted a vibrating element driven by a power unit that is mounted resiliently on the bottom plate. The vibrating element comprises at least two counterrotating eccentric weights mounted on a shaft, the phase positions of the eccentrics being capable of adjustment in relation to each other by means of an adjusting mechanism so that the direction of the resultant of the centrifugal forces can be arbitrarily selected in relation to the bottom plate. The location of the element and power unit in relation to each other on the bottom plate and the distribution of the masses oscillating with the bottom plate are chosen to minimize structural height and maximize translational motion both forward and in reverse. In order to bring about a change in the phase position of the eccentrics in relation to each other, one or more of the eccentrics is mounted in such a manner that it can rotate in relation to the shaft, and the direction of rotation of such weights is, with the aid of a sprocket and chain transmission, opposite to that of the other weights, which are rigidly mounted on the shaft. The resultant vibrational force generated during the rotation of the shaft is thus directional. By means of the adjusting mechanism the plate can be given both a vibratory compacting motion and a forward or reverse motion along the surface that is to be compacted.

5 Claims, 3 Drawing Figures

PLATE VIBRATOR

BACKGROUND OF THE INVENTION

This invention relates to compacting machinery and, more particularly, to a novel and highly-effective plate vibrator for compacting soil, asphalt and similar materials.

On conventional vibratory machines of the type in question, in which it is desired to give the plate both a vibratory motion and a forward directional movement, a vibrating element is positioned at the front part of a bottom plate and a power unit used for driving the element at the rear part of the bottom plate. This relative location produces the desired vibratory motion in the plate without the necessity of taking any special measures with regard to the distribution of the mass of the vibrating element and/or masses oscillating with the bottom plate. Under certain compacting conditions, however, it may be desirable to be able to move the plate both forward and in reverse. This is particularly the case when compacting pipe trenches and similar narrow spaces. In order to obtain similar conditions in both directions of movement, the vibrating element on these machines is generally situated in the center of the plate with the power unit positioned above the element. However, this leads to a tall structure and consequent instability of the plate.

Different adjusting mechanisms on plate vibrators of the type in question for changing the phase position of the eccentric weights in the vibrating element of the plate vibrator in relation to each other are known. Thus a conventional adjusting mechanism consists of a gear engagement system comprising two non-meshing main gears for the eccentric weights and two auxiliary gears in mesh with each other and with the main gears, the auxiliary gears being mounted in such a way that they can pivot in order to permit the phase position to be regulated.

Further, an adjusting mechanism is known in which the phase position of counterrotating eccentric weights is adjustable by means of gear sets in mesh with each other and axially adjustable gears.

All these conventional adjusting mechanisms for changing the direction of movement of the plate vibrator are, however, complicated and thus expensive and susceptible to damage in connection with hard usage on construction sites and therefore particularly prone to breakdowns with work stoppage as a result.

SUMMARY OF THE INVENTION

An object of the present invention is to provide a plate vibrator for driving forward and in reverse in which the structural height has been reduced to a minimum.

Another object of the invention is to distribute the masses arranged on the plate vibrator in such a way that good translational motion both forward and in reverse is obtained.

Yet another object of the invention is to provide an adjustable vibrating element for changing the direction of the vibrational force, whereby adjustment is achieved without the aid of a gearbox or corresponding gear engagement systems.

The foregoing and other objects are attained in accordance with the invention by arranging the vibrating element and power unit in relation to each other on the bottom plate so that the drive shaft of the power unit and the eccentric shaft of the element are parallel and situated one behind the other in the direction of movement of the plate. The distribution of the masses oscillating with the bottom plate is so selected that the common center of gravity of these masses, including the mass of the bottom plate, is situated between and above the lines of centrifugal force generated by the vibrating element when driving the vibrator forward and in reverse, respectively, and in a vertical plane which contains the lines of force.

BRIEF DESCRIPTION OF THE DRAWING

A better understanding of the invention may be gained from a consideration of the following detailed description of the preferred embodiments thereof in conjunction with the appended figures of the drawing, wherein.

DESCRIPTION OF THE PREFERRED EMBODIMENTS

Figure 1:
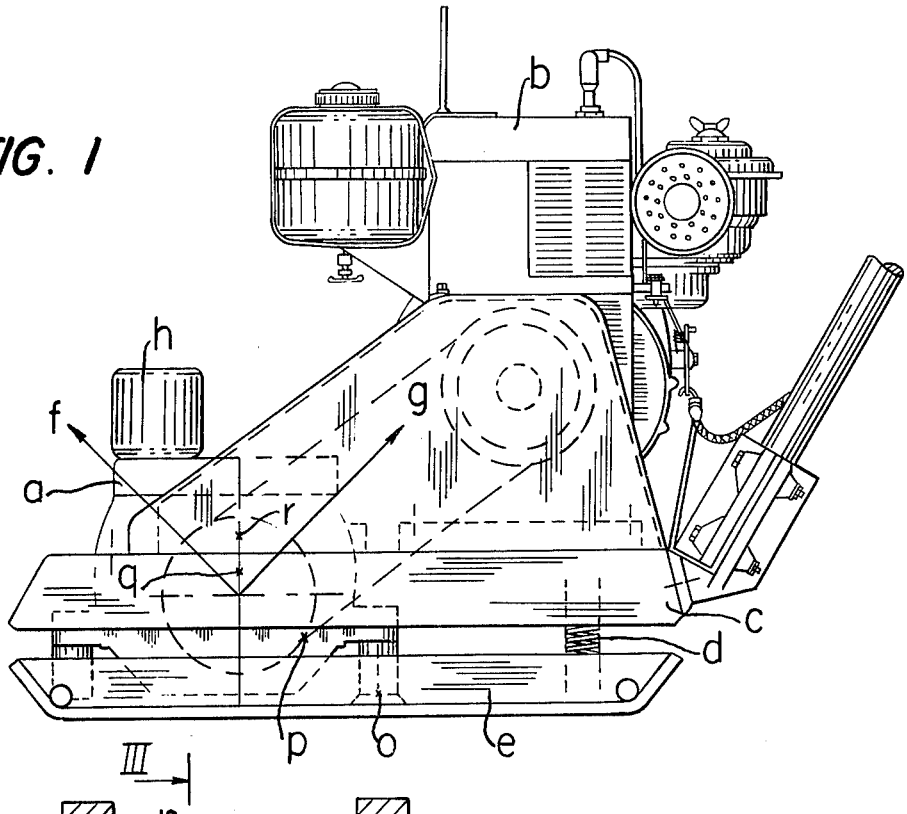
FIG. 1 is a schematic diagram in side elevation of a plate vibrator according to the invention.

FIG. 1 shows a vibrating element a in accordance with the invention, a power unit b, and a power unit mounting plate c which by means of springs d is resiliently supported on a bottom plate e. As is evident from the drawing, the power unit b and vibrating element a are positioned one behind the other in the direction of movement of the plate vibrator, whereby when driving forward, i.e. to the left in FIG. 1, the vibrating element a generates a resultant vibrational force which is indicated by an arrow f. For driving in reverse the vibrating element a is adjusted as described in detail below, and the resultant force, the vibrational force, has the direction indicated by an arrow g.

In FIG. 1 o designates the center of gravity of the bottom plate e, p the center of gravity of the bottom plate e and eccentric elements for a given position of the latter, and q the center of gravity of the eccentric elements in the same position.

In order to achieve optimum compaction efficiency and translational motion in the plate when driving both forward and in reverse, the distribution of the masses oscillating with the bottom plate e in accordance with the invention is so selected that the common center of gravity r of these masses, including the mass of the bottom plate, will be located between and above the lines of force f and g and in a vertical plane including those lines. This distribution of mass can be obtained by placing a counterweight, designated h in FIG. 1, on the bearing housing of the vibrating element. The counterweight may also constitute an integral part of the bearing housing or bottom plate e.

If the center of gravity r is on the line of force f, every part of the bottom plate will be given an equally large amplitude in relation to every other part, provided that the resultant of the centrifugal forces acts along the line of force f. With the center of gravity situated above the line f, a larger amplitude is obtained at the front part of the bottom plate than at the rear part of the plate, under the same conditions for the direction of the centrifugal force as stated above. Corresponding results obtain if the resultant force of the vibrating element has the direction g. Specifically, in the latter case the plate will move to the right in FIG. 1 and the "front" part of the plate is thereby given a larger amplitude than the "rear" part.

With the uneven distribution of amplitude as in the case in question, the ability of the plate vibrator to move forward on soft material is better than it would be if the amplitude were evenly distributed on the bottom plate. Thus the optimum effect is obtained by locating the center of gravity r between the lines of force f and g.

Figure 2:
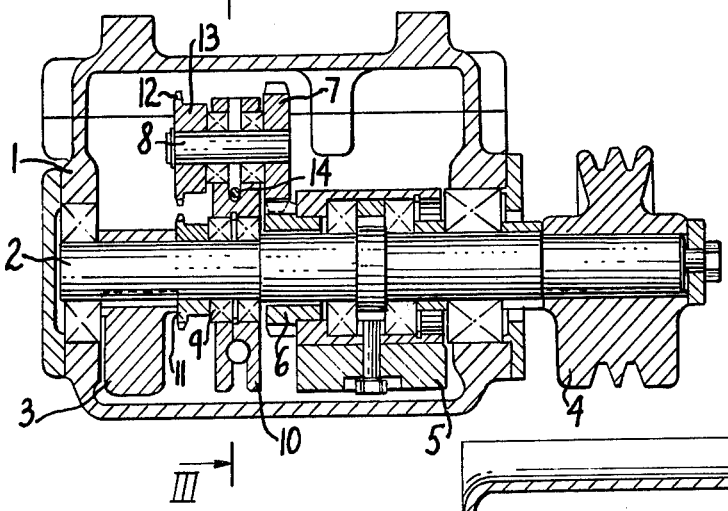
FIG. 2 is a cross section through a vibrating element used on the apparatus of FIG. 1.

FIG. 2 shows an embodiment of the vibrating element according to the invention. The element comprises a housing 1 with a shaft 2. Inside the housing and fixed to the shaft 2 is an eccentric weight 3. With its eccentricity directed in the same direction as that of the weight 3 but on an extension of the shaft 2 outside the housing 1 is a belt pulley 4 on which is rigidly mounted a mass that is eccentrically distributed in relation to the axis of rotation. Between these eccentrics and inside the housing a third eccentric 5 is arranged. The eccentric 5 is fitted with a gear 6 and mounted on the shaft 2 in such a manner that it can rotate with respect thereto. The gear 6 is in mesh with a gear 7, which with its shaft 8 is mounted in such a manner that it can rotate on a radially-protruding part of an adjusting mechanism 10 which is mounted in a bearing 9 on the shaft 2 in such a way that it can rotate with respect to the shaft 2 within a limited range. The gear 7 is driven by shaft 2 via a chain sprocket 11 rigidly mounted on the shaft 2, a chain 12 and a chain sprocket 13 rigidly connected to the shaft 8 of the gear 7. Through the gear transmission 6, 7 and the chain transmission 11, 12, 13 the eccentric 5 will rotate in a direction opposite to that of the shaft 2 and the eccentrics 3 and 4. However, the rotational speeds will be the same since the chain sprockets 11 and 13 are of equal size as also are the gears 6 and 7.

Figure 3:
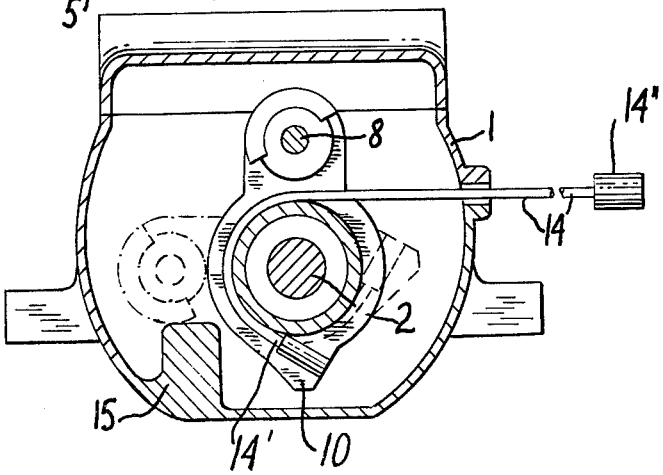
FIG. 3 is a cross section along the line III—III in FIG. 2, looking in the direction of the arrows.

The direction of rotation of the eccentric shaft 2 is so selected that the adjusting mechanism 10 continuously endeavors to bring about a setting of the eccentrics that will give the direction of force f. However, an elongated flexible control means, suitably a wire 14, is placed in a groove on the adjusting mechanism 10 and fastened at one end 14' (FIG. 3). During rotation of the shaft 2 the adjusting mechanism 10 is prevented from rotating in the direction of rotation of the shaft 2 by a force in the line 14 which is applied at the free external end 14' of the line. Pulling on the line 14 causes the adjusting mechanism 10 and therefore the eccentric 5 via gears 6 and 7 to change its angular position in relation to the eccentrics 3 and 4 mounted on the shaft 2. With the aid of the adjusting mechanism 10 the eccentric 5 can consequently be steplessly set by the operator of the plate vibrator at different angular positions in relation to the eccentrics 3 and 4, which gives a resultant centrifugal force in different directions.

At the two positions of the adjusting mechanism 10 which result in optimum translational motion forward and in reverse, respectively, stops against which the adjusting mechanism can be brought to rest are suitably arranged. Such a stop is designated 15 in FIG. 3. With the adjusting mechanism in the position indicated by broken lines in FIG. 3, a setting of the eccentrics 3, 4 and 5 is obtained which gives the direction of force f and causes the plate vibrator to move forward at maximum speed.

A corresponding stop, not shown, is arranged to obtain the direction of force g with which a maximum rearward motion is obtained. Between these two end positions an arbitrarily directed vibrational force can be obtained.

The invention consequently permits simple adjustment of the vibrating element for driving forward and in reverse and in addition the possibility of controlling the translational speed of the plate in both a forward and reverse direction.

Many modifications of the preferred embodiment of the invention disclosed above will readily occur to those skilled in the art upon consideration of this disclosure. For example, the wire 14 can be replaced by other elongated flexible control means such as a chain. Accordingly, the invention is as broad as the appended claims and equivalents thereof.

I claim:

1. A plate vibrator for compacting soil, asphalt and similar materials, comprising a bottom plate, a vibrating element rigidly mounted on the bottom plate, a power unit resiliently mounted on the bottom plate for driving the vibrating element, the vibrating element comprising a rotating shaft, at least two eccentric weights mounted on the rotating shaft, and an adjusting mechanism for altering the phase positions of the weights in relation to each other, the adjusting mechanism interacting with the eccentric weights for the purpose of achieving both a vibratory compacting motion and movement of the plate in a forward or reverse direction on the surface that is to be compacted, characterized in that the vibrating element and power unit are positioned one behind the other on the bottom plate of the plate vibrator and in that the distribution of the masses oscillating with the bottom plate is so selected that the common center of gravity of these masses, including the mass of the bottom plate, is situated between and above the lines of force of the centrifugal forces generated by the vibrating element when driving forward and in reverse, respectively, and in a vertical plane containing said lines of force, so that, for movement in either direction, the amplitude of vibration of the bottom plate is greater at the front or leading part of the bottom plate than at the rear or trailing part.

2. A plate vibrator as in claim 1, wherein at least one of the eccentric weights is fixed on the shaft and at least one of the eccentric weights is mounted in such a way that it is rotatable in relation to the shaft and is arranged to rotate at the same speed as, but in the opposite direction to, the fixed eccentric weight, further comprising means for rotating said rotatable eccentric weight, said means comprising a chain transmission driven by said shaft, a gear driven by the chain transmission and journalled in the adjusting mechanism, and a gear rigidly mounted on the rotatable eccentric weight and interacting with the gear journalled in the adjusting mechanism.

3. A plate vibrator for compacting soil, asphalt and similar materials, comprising a bottom plate, a vibrating element rigidly mounted on the bottom plate, a power unit resiliently mounted on the bottom plate for driving the vibrating element, the vibrating element comprising a rotating shaft, at least two eccentric weights mounted on the rotating shaft, and an adjusting mechanism for altering the phase positions of the weights in relation to each other, the adjusting mechanism interacting with the eccentric weights for the purpose of achieving both a vibratory compacting motion and movement of the plate in a forward or reverse direction on the surface that is to be compacted, characterized in that the vibrating element and power unit are positioned one behind the other on the bottom plate of the plate vibrator, whereby the distribution of the masses oscillating with the bottom plate is so selected that the common center of gravity of these masses, including the mass of the bottom plate, is situated between and above the lines of force of the centrifugal forces generated by the vibrating element when driving forward and in reverse, respectively, and in a vertical plane containing said lines of force, wherein at least one of the eccentric weights is fixed on the shaft and at least one of the eccentric weights is mounted in such a way that it is rotatable in relation to the shaft and is arranged to rotate at the same speed as, but in the opposite direction to, the fixed eccentric weight, further comprising means for rotating said rotatable eccentric weight, said means comprising a chain transmission driven by said shaft, a gear driven by the chain transmission and journalled in the adjusting mechanism, and a gear rigidly mounted on the rotatable eccentric weight and interacting with the gear journalled in the adjusting mechanism, and wherein the chain transmission comprises a chain sprocket journalled concentrically with the adjusting mechanism and attached to the fixed eccentric weight, a chain sprocket mounted in such a way that it can rotate on a radially protruding part of the adjusting mechanism, a chain connecting the two sprockets, and a sprocket shaft mounting the second-name of said sprockets, and wherein the gear journalled in the adjusting mechanism is rigidly mounted on the sprocket shaft.

4. A plate vibrator for compacting soil, asphalt and similar materials, comprising a bottom plate, a vibrating element rigidly mounted on the bottom plate, a power unit resiliently mounted on the bottom plate for driving the vibrating element, the vibrating element comprising a rotating shaft, at least two eccentric weights mounted on the rotating shaft, and an adjusting mechanism for altering the phase positions of the weights in relation to each other, the adjusting mechanism interacting with the eccentric weights for the purpose of achieving both a vibratory compacting motion and movement of the plate in a forward or reverse direction on the surface that is to be compacted, characterized in that the vibrating element and power unit are positioned one behind the other on the bottom plate of the plate vibrator, whereby the distribution of the masses oscillating with the bottom plate is so selected that the common center of gravity of these masses, including the mass of the bottom plate, is situated between and above the lines of force of the centrifugal forces generated by the vibrating element when driving forward and in reverse, respectively, and in a vertical plane containing said lines of force, wherein at least one of the eccentric weights is fixed on the shaft and at least one of the eccentric weights is mounted in such a way that it is rotatable in relation to the shaft and is arranged to rotate at the same speed as, but in the opposite direction to, the fixed eccentric weight, further comprising means for rotating said rotatable eccentric weight, said means comprising a chain transmission driven by said shaft, a gear driven by the chain transmission and journalled in the adjusting mechanism, and a gear rigidly mounted on the rotatable eccentric weight and interacting with the gear journalled in the adjusting mechanism, and wherein the adjusting mechanism is mounted in such a manner that it can rotate on the shaft of the vibrating element and formed with a groove arranged concentrically in relation to this shaft, further comprising elongated flexible control means placed in said groove, one end of said flexible control means being attached to the adjusting mechanism and the other end of said flexible control means extending away therefrom to permit control by an operator of the angular position of said adjusting mechanism.

5. A plate vibrator as in claim 4, further comprising at least one stop against which the adjusting mechanism comes to rest when driving forward and in reverse, respectively, at optimum speed.

* * * * *